US009073283B2

(12) United States Patent
Gnan et al.

(10) Patent No.: US 9,073,283 B2
(45) Date of Patent: Jul. 7, 2015

(54) CORRUGATING ROLLER FOR THE MANUFACTURE OF CORRUGATED CARDBOARD

(75) Inventors: Alfons Gnan, Vilseck (DE); Markus Schell, Weiden (DE)

(73) Assignee: BHS Corrugated Maschinen-und Anlagenbau GmbH, Weiherhammer (DE)

( * ) Notice: Subject to any disclaimer, the term of this patent is extended or adjusted under 35 U.S.C. 154(b) by 739 days.

(21) Appl. No.: 13/303,831

(22) Filed: Nov. 23, 2011

(65) Prior Publication Data

US 2012/0157276 A1 Jun. 21, 2012

(30) Foreign Application Priority Data

Dec. 20, 2010 (EP) ..... 10195962

(51) Int. Cl.

| | |
|---|---|
| ***B21B 1/40*** | (2006.01) |
| ***B31F 1/24*** | (2006.01) |
| ***B31F 1/20*** | (2006.01) |
| ***B31F 1/28*** | (2006.01) |

(52) U.S. Cl.

CPC ..... *B31F 1/285* (2013.01); *B31F 1/2854* (2013.01); *B31F 1/2863* (2013.01)

(58) Field of Classification Search

CPC ..... B31F 1/005; B31F 1/28; B31F 1/285; B31F 1/2863; B31F 1/2854; B21B 27/005; B21B 27/032; D21F 3/083; D21F 3/086

USPC ..... 492/1, 15, 28, 30, 31, 33, 34, 46, 48, 492/35; 29/895, 895.31; 72/199, 252.5, 72/370.21; 101/5, 6, 22, 23, 28; 156/205, 156/462, 470, 472, 473; 425/369; 493/463

See application file for complete search history.

(56) References Cited

U.S. PATENT DOCUMENTS

| | | | | |
|---|---|---|---|---|
| 4,245,975 | A * | 1/1981 | Hattori | 425/363 |
| 4,310,375 | A | 1/1982 | Seki | |

(Continued)

FOREIGN PATENT DOCUMENTS

| | | | |
|---|---|---|---|
| CN | 1733464 | A | 2/2006 |
| DE | 4341730 | A1 | 6/1995 |

(Continued)

OTHER PUBLICATIONS

PTO Human Translation of JP H03-121830A (Quadrant Section 8, line 19 to Quadrant Section 11, line 16).*

*Primary Examiner* — Sarang Afzali
(74) *Attorney, Agent, or Firm* — McGlew and Tuttle, P.C.

(57) ABSTRACT

A corrugating roller, for the manufacture of corrugated cardboard, has a rotation axis and a corrugation. The corrugation has corrugation peaks and corrugation troughs as well as corrugation flanks, which connect the corrugation peaks and the corrugation troughs with each other. The corrugating roller has an air discharge device with an air collection groove, which is open outwardly in a radial direction, runs at least section-wise around the rotation axis, intersects at least some of the corrugation peaks and is limited by a first and a second side wall, which face each other. The air discharge device has an air connection channel, which extends from the side walls of the air collection groove, and an air suction channel, which is in flow connection with the air connection channel and can be subjected to negative pressure.

20 Claims, 3 Drawing Sheets

(56) References Cited

U.S. PATENT DOCUMENTS

| | | | | | |
|---|---|---|---|---|---|
| 4,348,250 | A | * | 9/1982 | Bromley | 156/473 |
| 4,368,094 | A | * | 1/1983 | Mayer et al. | 156/473 |
| 4,542,566 | A | * | 9/1985 | Sukenik | 493/463 |
| 5,489,081 | A | * | 2/1996 | Coffey | 248/603 |
| 5,728,256 | A | * | 3/1998 | Schulz et al. | 156/472 |
| 6,155,320 | A | * | 12/2000 | Finke et al. | 156/472 |
| 7,480,995 | B2 | * | 1/2009 | Adami et al. | 29/895 |

FOREIGN PATENT DOCUMENTS

| | | | |
|---|---|---|---|
| EP | 0 009 907 | A1 | 4/1980 |
| EP | 0 657 275 | A1 | 6/1995 |
| EP | 0 657 275 | B1 | 5/1998 |
| GB | 2 069 555 | A | 8/1981 |
| JP | H03-121830 | A | 5/1991 |

* cited by examiner

CORRUGATING ROLLER FOR THE MANUFACTURE OF CORRUGATED CARDBOARD

CROSS-REFERENCES TO RELATED APPLICATIONS

This application claims the priority of European Patent Application, Serial no. 10 195 962.5, filed Dec. 20, 2010, the content of which is incorporated herein by reference in its entirety as if fully set forth herein.

FIELD OF THE INVENTION

The invention relates to a corrugating roller for the manufacture of corrugated cardboard. The invention also relates to a corrugated cardboard machine for the manufacture of corrugated cardboard with such a corrugating roller.

BACKGROUND OF THE INVENTION

Generic corrugating rollers are known from EP 0 657 275 B1. Said corrugating rollers have proven their value. They exhibit encircling air collection grooves, from whose grove bottom there extend air connection bores. The air connection bores lead into air suction channels, which can be subjected to negative pressure.

SUMMARY OF THE INVENTION

It is an object of the invention to provide a corrugating roller that has an extremely long service life. It is also an object of the invention to create a corrugating roller which is particularly easy and inexpensive to manufacture. A corresponding corrugated cardboard machine is also to be provided.

According to the invention said object is achieved by a corrugating roller for the manufacture of corrugated cardboard, having a rotation axis, a corrugation for corrugating the corrugated cardboard, the corrugation comprising, corrugation peaks, corrugation troughs, which are arranged alternately to the corrugation peaks, and corrugation flanks, which extend between the corrugation peaks and the corrugation troughs and connect them with one another, and an air discharge device, exhibiting at least one air collection groove, which is open outwardly in the radial direction, runs at least section-wise around the rotation axis, intersects some of the corrugation peaks, and is limited by a first and a second side wall and, respectively, which face each other, at least one air connection channel, which extends from at least one of the side walls of at least one air collection groove, and at least one air suction channel which is in flow connection with the at least one air connection channel, and can be subjected to negative pressure.

Said object is further achieved by a corrugated cardboard machine for the manufacture of corrugated cardboard, comprising at least one corrugation web feeding device to feed at least one corrugation web, at least one corrugation device for corrugating the at least one corrugation web, the at least one corrugation device comprising at least one rotatably driveable corrugating roller according to one of the above claims, and at least one counter-corrugating roller assigned to the at least one corrugating roller, at least one cover web feeding device to feed at least one cover web, and at least one connection unit to connect the at least one corrugation web and the at least one cover web with each other.

The core of the invention is that at least one air connection channel extends sideways from the at least one air collection groove, especially from its flank. Roller breakages in the transition area between the groove bottom of the at least one air collection groove and the at least one air connection channel, which occur with the corrugating rollers known from prior art, are thus effectively prevented. Through the air discharge device there can be discharged especially air that is trapped in the area of the corrugation troughs of the corrugating roller during the interaction with a counter-corrugating roller between the corrugating roller and the web to be corrugated. The result of the discharge of the air is that the manufacture of the corrugated cardboard is not adversely affected by the air entrapment. Furthermore, the web to be corrugated can be securely fixed on the corrugating roller by the air discharge device.

There can be envisaged exactly one air collection groove. However, there may also exist several air collection grooves having regular and/or irregular distances relative to each other. Preferably, the at least one air collection groove lies in a plane that is perpendicular to the rotation axis. The plane is determined by the course of the air collection groove.

Conveniently, the at least one air connection channel is formed as a bore. It is advantageous if the at least one air connection channel runs straight and/or is formed so as to be closed over its cross-section. Preferably, the at least one air connection channel has a circular cross-section.

Preferably, the at least one air suction channel extends parallel to the rotation axis. Negative pressure from a negative pressure unit or source can be applied to the at least one air suction channel. The negative pressure unit can be a negative pressure pump. Preferably several air suction channels are envisaged.

The corrugation can extend parallel to the rotation axis. However, it can also lie in at least one plane that extends, at least section-wise, obliquely to the rotation axis. The corrugation can have a special geometric progression such as a wave-like progression.

The corrugating roller, in which the air collection groove exhibits a radially outward head area, the air connection channel extending from the head area of the air collection groove, is extremely easy to manufacture. Moreover, an extremely large air quantity can be discharged this way.

The embodiment, in which the air connection channel also extends from a corrugation trough, too, allows an extremely large air quantity to be discharged.

Through the embodiment, in which the air connection channel runs obliquely to the air collection groove, the entrapped air is extremely easy to extract by suction. Said embodiment is, in term of flow, especially favourable. The air connection channel can also run obliquely relative to the rotation axis, and directly towards it. It can, however, also extend skewedly to the rotation axis.

The corrugating roller, in which the side walls run parallel to each other, is extremely easy to manufacture. The air collection groove thus has a constant opening width. Alternatively, it can also taper from radially outward to radially inward, at least section-wise.

The air collection groove can, in its depth, follow the profile of the corrugation so that the air collection groove exhibits a constant depth. The grove bottom of the air collection groove can, however, also have a constant distance to the rotation axis so that, because of the corrugation, the air collection groove exhibits quasi-different depths.

Through the embodiment, in which the air collection groove runs fully around the rotation axis, an extremely large air quantity is again dischargeable. The air collection groove is thus closed over the circumference of the corrugating roller.

In a corrugating roller, in which the air collection groove runs only over a partial circumference of the corrugating roller around the rotation axis, the air collection groove extends only over a limited partial circumference of the corrugating roller. The air collection groove is thus not closed over the circumference of the corrugating roller. The air collection groove is thus formed by at least one individual section.

The embodiment, in which the air collection groove lies in at least one plane, which runs obliquely to the rotation axis, results in an especially advantageous air discharge. The air collection groove thus runs at least section-wise obliquely to the rotation axis.

Several air collection grooves being envisaged, and at least two of the air collection grooves lying in intersecting planes can intersect each other and/or end spaced apart from each other, it being possible for several air collection grooves to run parallel to each other.

The embodiment, in which the air collection groove exhibits a radially inward bottom area, which has a closed shape, is characterised by its extremely high fatigue strength. The bottom area is undisturbed. It is thus free from an air connection channel or air connection channels. Above all, an inlet opening of an air connection channel is especially not envisaged there.

In a corrugating roller being formed as a ring-type roller sleeve, in which the air discharge device is arranged, it is beneficial if the at least one air collection groove, the at least one air connection channel and the at least one air suction channel are arranged fully inside the roller sleeve.

The connection unit for connecting the at least one corrugation web and the at least one cover web with each other, preferably comprises a gluing unit for gluing the corrugation web and the cover web with each other.

In the following a preferred embodiment of the invention is described as an example with reference to the drawings attached.

DESCRIPTION OF THE PREFERRED EMBODIMENT

Figure 1:
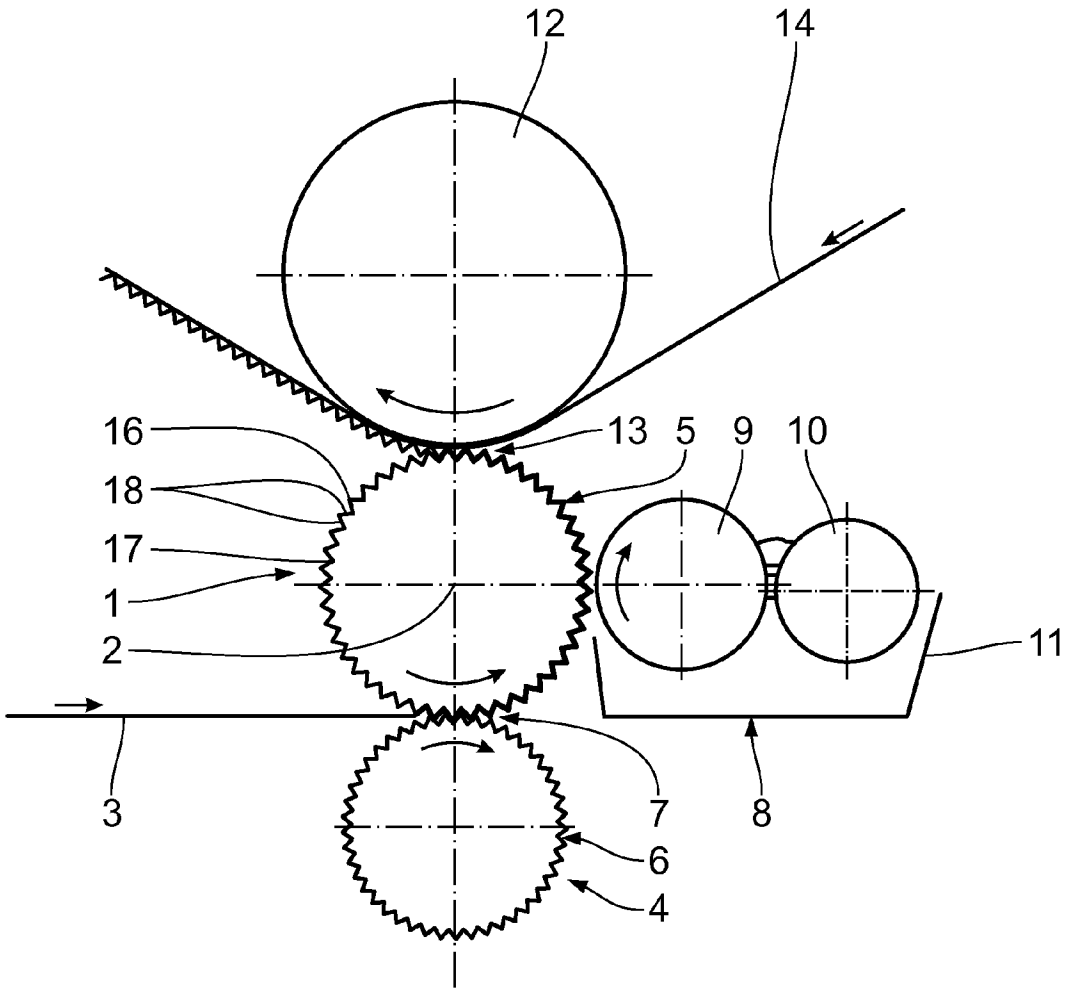
FIG. 1 shows a schematic representation of a corrugated cardboard machine according to the invention.
Figure 2:
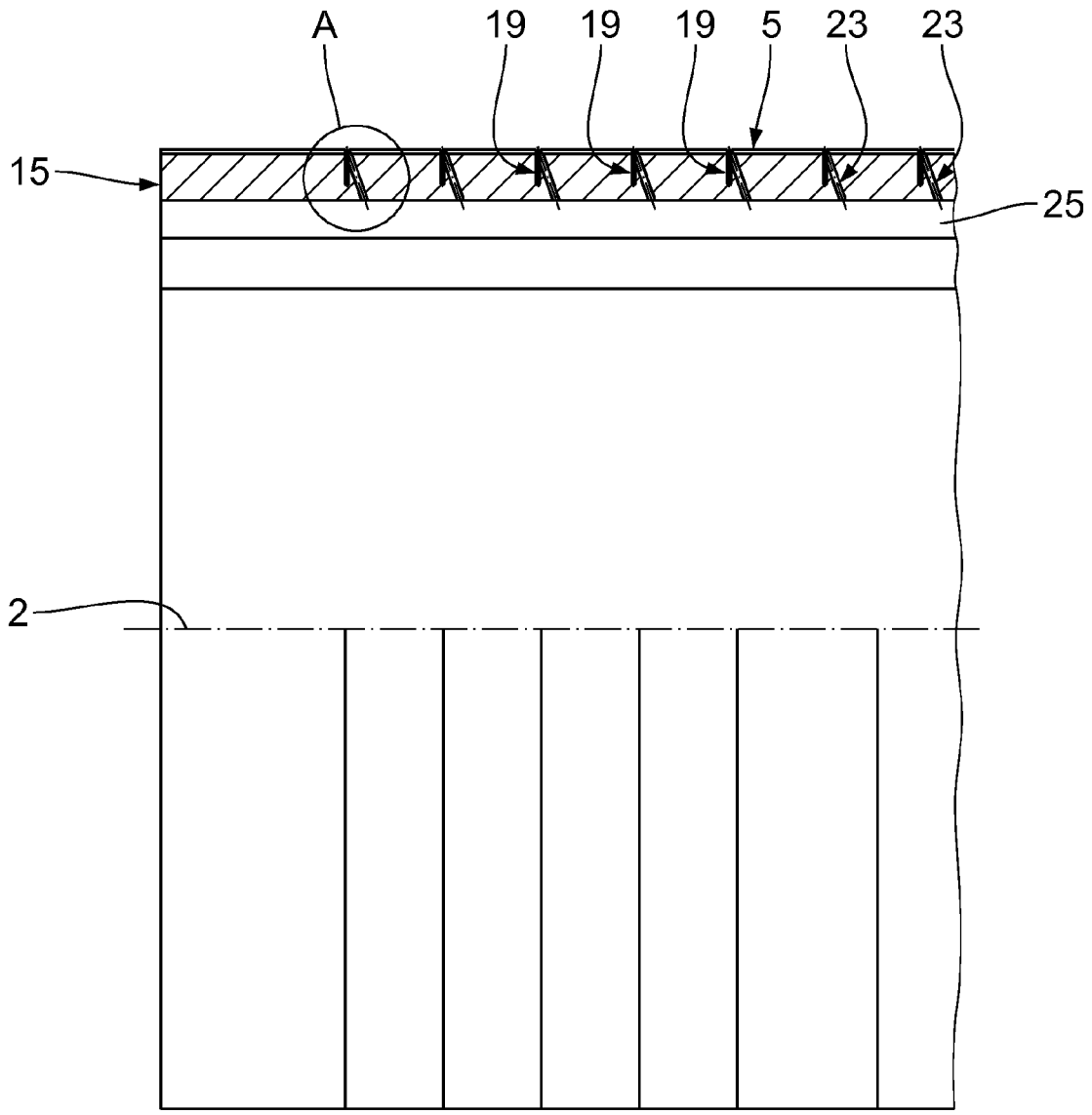
FIG. 2 shows a section through a part of a corrugating roller according to the invention.
Figure 3:
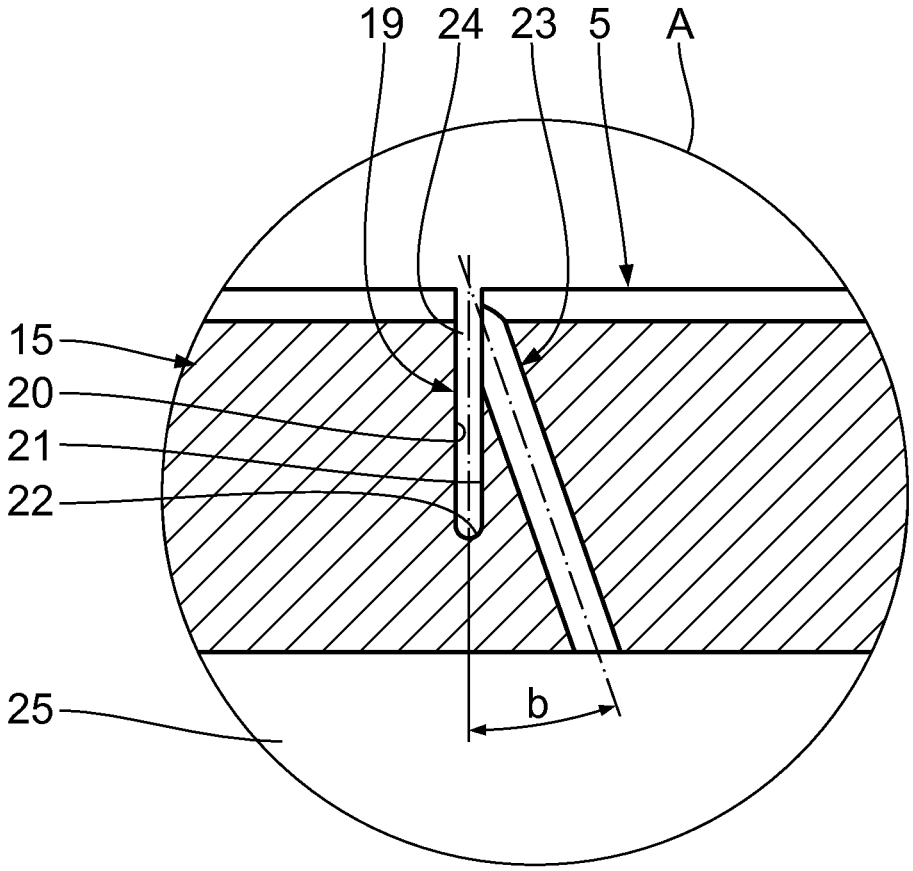
FIG. 3 shows the detail A shown in FIG. 2.

The corrugated cardboard machine shown schematically in FIG. 1 serves to manufacture one-sided corrugated cardboard. It exhibits a central corrugating roller 1, which is rotatably driven around its rotation axis 2 and is correspondingly rotatably mounted via bearing devices (not shown). Around a wrap angle of about 180° there is guided a corrugation web 3 around the corrugating roller 1. The corrugation web 3 comes from a corrugation web storage device (not shown) and is guided via a corrugation web feeding device (not shown) to the corrugating roller 1. The corrugation web storage device is preferably designed as a storage roller.

Below the corrugating roller 1 there is arranged a counter-corrugating roller 4, which is rotatably driven in opposite direction to the corrugating roller 1 or is practically moved along during operation by the corrugating roller 1. The counter-corrugating roller 4 is rotatably mounted accordingly via bearing devices (not shown). The corrugating roller 1 and the counter-corrugating roller 4 each exhibit a corrugation 5 and 6, respectively. The corrugations 5, 6 are in mesh with each other, as a result of which the corrugation web 3, which is flat prior to entry into the roller gap 7 formed between the corrugating roller 1 and the counter-corrugating roller 4, is pressed into the corrugation 5 of the corrugating roller 1 and is thus corrugated.

On the side next to the corrugating roller 1 there is arranged a gluing unit 8, which comprises an application roller 9 and a so-called squeeze roller 10 and a glue pan 11 which is open towards the top. The application roller 9 and the squeeze roller 10 are rotatably mounted. The squeeze roller 10 and the application roller 9 on the one hand, and the application roller 9 and the corrugating roller 1 on the other hand, are in mutual contact, whereby there is applied a defined glue layer onto the protruding peak areas of the corrugation web 3 in the usual manner. To this end the application roller 9 protrudes into the glue of the glue pan 11, the squeeze roller 10 squeezing off excessive glue. Other gluing units known from prior art may alternatively be applied here.

Above the corrugating roller 1 a smooth pressure roller 12 is rotatably mounted. Between the pressure roller 12 and the corrugating roller 1 there is formed a roller gap 13. A cover web 14 is guided through the roller gap 13. The cover web 14 comes from a cover web storage device (not shown) and is guided via a cover web feeding device (not shown) into the roller gap 13. The cover web storage device is preferably designed as a storage roller. In the roller gap 13 the corrugation web 3 and the cover web 14 are glued to one another such that corrugated cardboard laminated on one side is created.

The corrugating roller 1 also exhibits a heater (not shown) and an air discharge device, also not shown in FIG. 1. The air discharge device on the one hand affixes the corrugation web 3 to the corrugating roller 1. On the other hand, air, which is trapped between the corrugation web 3 and the corrugating roller 1 and can thus adversely affect the manufacture of the corrugated cardboard, can be discharged through the air discharge device.

The corrugating roller 1 exhibits a hollow cylindrical roller sleeve 15, which is rotatably driveable around the rotation axis 2. The roller sleeve 15 has on its outside the corrugation 5, which extends parallel to the rotation axis 2. The corrugation 5 exhibits radially outward corrugation peaks 16 and radially inward corrugation troughs 17, which are arranged alternately to each other and run parallel to the rotation axis 2. Furthermore, the corrugation 5 comprises corrugation flanks 18, which extend between the corrugation peaks 16 and the corrugation troughs 17 and connect them with each other. The corrugation peaks 16 are each formed by partial arches.

In the roller sleeve 15 there are also envisaged several air collection grooves 19, which each run in a plane perpendicular to the rotation axis 2. The air collection grooves 19 have a ring-like shape. They are open in an outward radial direction and run fully around the rotation axis 2 in accordance with the described embodiment. The air collection grooves 19 can be equally spaced relative to each other in the direction of the rotation axis 2. They exhibit a slightly greater depth than the corrugation 5.

Each air collection groove 19 is limited laterally in the direction of the rotation axis 2 by a first side wall 20 and a second side wall 21. The side walls 20, 21 of an air collection groove 19 face each other. Preferably said side walls run parallel to each other and have a distance of 0.5 mm to 6 mm, preferably of 1 mm to 3 mm, towards each other. The first side wall 20 and the second side wall 21 of an air collection groove 19 are connected via a radially inward grove bottom 22, which is preferably curved in an arcuate shape in the section. The grove bottom 22 can, however, also take another course. It can, for example, also extend in a straight direction at least section-wise.

At least one air connection channel 23, which is preferably formed as a straight bore with a circular cross-section in the roller sleeve 15, extends laterally from each air collection groove 19. The at least one air connection channel 23 conveniently has a diameter of between 0.5 mm and 6 mm, more preferably between 1 mm and 3 mm. It is beneficial if several air connection channels 23 extend from an air collection groove 19, which then preferably have an identical angular distance to each other.

The air connection channels 23 each extend from the side wall 20 or 21 of the air collection grooves 19. Corresponding inlet openings are envisaged therefor in the side walls 20 and 21. According to the described embodiment the air connection channels 23 all extend from the second side wall 21, i. e. they all run away from the same side of the air collection grooves 19. The air connection channels 23 extend from a radially outward head area 24 of the corresponding air collection groove 19. They are therefore in connection with the corresponding air collection groove 19 at a distance to the relevant grove bottom 22. Between an air collection groove 19 and an air connection channel 23 there is in each case an angle b of between 2° and 45°, preferably between 5° and 20°. The air connection channels 23 all extend from the relevant air collection groove 19 in the direction towards the rotation axis 2 and also alongside it. They run radially and obliquely to the rotation axis 2. The air connection channels 23 can alternatively extend from different sides 20, 21 of the air collection grooves 19. An alternating arrangement is possible. Alternatively, the air connection channels 23, which each extend from one side 20 or 21, can be grouped.

The air connection channels 23 all lead into air suction channels 25. To this end, corresponding openings are envisaged in the air connection channels 23. The air suction channels 25 run parallel to the rotation axis 2 and around it and are arranged in the roller sleeve 15. The air suction channels 25 preferably have a circular shape in the cross-section. The air suction channels 25 are in flow connection with the negative pressure or vacuum unit. The air collection grooves 19 end at a distance to the air connection channels.

The air collection grooves 19, the air connection channels 23 and the air suction channels 25 together form the air discharge device.

In the following the air discharge device is described in operation. Negative pressure is applied to the air suction channels 25 through the negative pressure unit. With the air suction channels 25 being at a negative pressure, air is drawn from the air collection grooves 19 via the air connection channels 23. This is due to the fact that the air collection grooves 19 are in flow connection with the air suction channels 25 via the air connection channels 23 and can thus also be subjected to a negative pressure. The air collection grooves 19 reach all the way to the corrugation web 3.

The counter-corrugating roller 4 can also comprise the described air discharge device.

What is claimed is:

1. A corrugating roller for the manufacturing a corrugated cardboard, the corrugating roller comprising:

a rotation axis;

a corrugation for corrugating the corrugated cardboard, the corrugation comprising corrugation peaks, corrugation troughs, which are arranged alternately to the corrugation peaks, and corrugation flanks, which extend between the corrugation peaks and the corrugation troughs and connect them with one another; and an air discharge device comprising at least one air collection groove, which is open outwardly in a radial direction, said at least one air collection groove extending at least section-wise around the rotation axis, said at least one air collection groove intersecting some of the corrugation peaks, and said at least one air collection groove being limited by a first side wall and a second side wall, respectively, which face each other, said air discharge device further comprising at least one air connection channel, which extends from at least one of the first side wall and the second side wall of at least one air collection groove, and said air discharge device further comprising at least one air suction channel, which is in flow connection with the at least one air connection channel, and can be subjected to negative pressure, wherein the air connection channel extends obliquely to the air collection groove.

2. The corrugating roller according to claim 1, wherein the air collection groove comprises a radially outward head area, the air connection channel extending from the head area of the air collection groove.

3. The corrugating roller according to claim 1, wherein the air connection channel extends from a corrugation trough.

4. The corrugating roller according to claim 1, wherein between the air connection channel and the air collection groove there is an angle b, where: $2° < b < 45°$.

5. The corrugating roller according to claim 1, wherein between the air connection channel and the air collection groove there is an angle b, where: $5° < b < 20°$.

6. The corrugating roller according to claim 1, wherein the first side and the second side wall extend parallel to each other.

7. The corrugating roller according to claim 1, wherein the air collection groove extends fully around the rotation axis.

8. The corrugating roller according to claim 1, wherein the air collection groove extends only over a partial circumference of the corrugating roller around the rotation axis.

9. The corrugating roller according to claim 1, wherein the air collection groove lies in at least one plane, which extends obliquely to the rotation axis.

10. The corrugating roller according to claim 1, wherein several air collection grooves are provided, at least two of the air collection grooves lying in intersecting planes.

11. The corrugating roller according to claim 1, wherein the air collection groove comprises a radially inward bottom area, which has a closed shape.

12. The corrugating roller according to claim 1 comprising a ring-type roller sleeve, in which the air discharge device is arranged.

13. The corrugating roller according to claim 1, wherein several air collection grooves are provided, the at least one air connection channel extending from each second side wall.

14. The corrugating roller according to claim 1, wherein at least one air connection channel is in an area of each corrugation trough.

15. A corrugating roller for manufacturing a corrugated cardboard, the corrugating roller comprising:

a rotation axis;

a corrugation comprising corrugation peaks, corrugation troughs and corrugation flanks, said corrugation peaks being connected to said corrugation troughs via said corrugation flanks; and an air discharge device comprising at least one air collection groove, said at least one air collection groove being open at one end thereof, said at least one air collection groove being defined by at least a first side wall and a second side wall, said first side wall being located opposite said second side wall, said air discharge device further comprising at least one air connection channel, said at least one air connection channel extending from at least one of the first side wall and the second side wall, wherein said air connection channel extends at an oblique angle with respect to said air collection groove, said air discharge device further comprising at least one air suction channel, said at least one air suction channel being in fluid communication with said at least one air connection channel.

16. The corrugating roller according to claim 15, wherein said at least one air collection groove extends at least section-wise around the rotation axis, said at least one air collection groove intersecting some of the corrugation peaks, said at least one air collection groove extending at least section-wise around the rotation axis, said at least one air collection groove intersecting some of the corrugation peaks, said at least one air suction channel being subjected to negative pressure.

17. The corrugating roller according to claim 15, wherein said first side wall and said second side wall extend in a radial direction with respect to said rotation axis, said first side wall and said second side wall being integrally connected to a lower wall, said first side wall, said second side wall and said lower wall defining said at least one air collection groove.

18. A corrugating roller for manufacturing a corrugated cardboard, the corrugating roller comprising:

a rotation axis;

a roller sleeve comprising a corrugation, said corrugation comprising corrugation peaks, corrugation troughs and corrugation flanks, said corrugation peaks being connected to said corrugation troughs via said corrugation flanks, said roller sleeve comprising a first side wall portion, a second side wall portion and an angled wall portion, said angled wall portion extending at an oblique angle with respect to at least one of said first side wall portion and said second side wall portion, at least a portion of said angle wall portion being located adjacent to one of said first side wall portion and said second side wall portion, said first side wall portion and said second side wall portion extending in a radial direction with respect to said rotation axis, said first side wall portion being located opposite said second side wall portion; and an air discharge device comprising at least one air collection groove, at least said first side wall portion and said second side wall portion defining said at least one air collection groove, said at least one air collection groove being open at one end thereof, said air discharge device further comprising at least one air connection channel, said angled side wall portion defining at least a portion of said at least one air connection channel, wherein said air connection channel extends at said oblique angle with respect to said air collection groove, said air discharge device further comprising at least one air suction channel, said at least one air suction channel being in fluid communication with said at least one air connection channel.

19. The corrugating roller according to claim 18, wherein said roller sleeve comprises a lower wall portion, said first side wall portion and said second side wall portion are integrally connected to said lower wall portion, said first side wall portion, said second side wall portion and said lower wall portion defining said at least one air collection groove, said at least one air suction channel being in fluid communication with said air collection groove via said at least one air connection channel.

20. The corrugating roller according to claim 19, wherein said at least one air collection groove extends at least section-wise around the rotation axis, said at least one air collection groove intersecting some of the corrugation peaks, said at least one air collection groove extending at least section-wise about the rotation axis, said at least one air collection groove intersecting some of the corrugation peaks, said at least one air suction channel being subjected to negative pressure.

* * * * *